US009404240B2

(12) United States Patent
Kunz

(10) Patent No.: US 9,404,240 B2
(45) Date of Patent: Aug. 2, 2016

(54) BUCKET LIP PROTECTION ASSEMBLIES AND LIP ADAPTERS FOR SAME

(71) Applicant: Caterpillar Inc., Peoria, IL (US)

(72) Inventor: Phillip John Kunz, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 33 days.

(21) Appl. No.: 14/074,387

(22) Filed: Nov. 7, 2013

(65) Prior Publication Data

US 2015/0121729 A1 May 7, 2015

(51) Int. Cl.
*E02F 9/28* (2006.01)

(52) U.S. Cl.
CPC ..... *E02F 9/2883* (2013.01)

(58) Field of Classification Search
USPC ..... 37/451, 455
See application file for complete search history.

(56) References Cited

U.S. PATENT DOCUMENTS

| | | | | |
|---|---|---|---|---|
| 775,770 | A | | 11/1904 | Herrod, Jr. |
| 1,485,879 | A | | 3/1924 | Page |
| 1,544,222 | A | | 6/1925 | Crosby |
| 1,783,350 | A | | 12/1928 | Watts |
| 1,697,538 | A | | 1/1929 | Moore |
| 1,788,350 | A | | 1/1931 | Scofield et al. |
| 1,845,677 | A | | 2/1932 | Van Cortright |
| 1,868,247 | A | | 7/1932 | Page |
| 1,885,326 | A | | 11/1932 | Brune |
| 2,167,425 | A | | 7/1939 | Page |
| 2,311,463 | A | | 2/1943 | Page |
| 2,385,395 | A | | 9/1945 | Baer |
| 2,393,706 | A | | 1/1946 | Page |
| 2,393,708 | A | | 1/1946 | Reichel |
| 2,919,506 | A | | 1/1960 | Larsen |
| 2,996,291 | A | | 8/1961 | Krekeler |
| 3,160,967 | A | * | 12/1964 | Nichols ..... 37/446 |
| 3,345,765 | A | | 10/1967 | Petersen |
| 3,357,117 | A | | 12/1967 | Petersen |
| 3,371,437 | A | | 3/1968 | Wilson et al. |
| 3,388,488 | A | | 6/1968 | Duplessis |
| 3,426,459 | A | | 2/1969 | Petersen |
| 3,537,735 | A | | 11/1970 | Hawk |
| 3,572,785 | A | | 3/1971 | Larson |
| 3,664,044 | A | | 5/1972 | Hahn |
| 3,685,177 | A | | 8/1972 | Hahn et al. |
| 3,762,079 | A | | 10/1973 | Lukavich et al. |
| 3,784,258 | A | | 1/1974 | Braun et al. |

(Continued)

FOREIGN PATENT DOCUMENTS

| | | |
|---|---|---|
| DE | 2153964 A1 | 9/1972 |
| EP | 0414345 | 2/1991 |

(Continued)

*Primary Examiner* — Gary Hartmann
(74) *Attorney, Agent, or Firm* — Finnegan, Henderson, Farabow, Garrett & Dunner, LLP

(57) ABSTRACT

Various exemplary embodiments of a bucket lip protection assembly are disclosed. In one exemplary embodiment, the bucket lip protection assembly may include a bucket lip protector. The lip protector may include a front portion for engaging material being moved. The lip protector may also include a rear portion opposite the front portion. In addition, the bucket lip protection assembly may include a lip adapter for stabilizing the lip protector relative to a bucket lip. The lip adapter may include a plurality of lip protector engagement surfaces, which may define at least two recessed portions and at least one non-recessed portion of the lip adapter. The lip adapter may also include a bucket lip attachment portion.

18 Claims, 6 Drawing Sheets

(56) References Cited

U.S. PATENT DOCUMENTS

| | | | | |
|---|---|---|---|---|
| 3,831,298 | A | 8/1974 | Helton et al. | |
| 3,841,007 | A | 10/1974 | Howarth et al. | |
| 3,896,569 | A | 7/1975 | Thompson et al. | |
| 3,897,642 | A | 8/1975 | Helton et al. | |
| 3,919,792 | A | 11/1975 | Hahn et al. | |
| 3,964,152 | A | 6/1976 | Shankwitz et al. | |
| 3,967,399 | A | 7/1976 | Heinold et al. | |
| 3,974,579 | A | 8/1976 | Black et al. | |
| 3,995,384 | A | 12/1976 | Wood | |
| 4,006,544 | A | 2/1977 | Stepe | |
| 4,089,613 | A | 5/1978 | Babbitt, Jr. | |
| 4,146,115 | A | 3/1979 | Tazelaar | |
| 4,205,469 | A | 6/1980 | Johansson et al. | |
| 4,233,761 | A | 11/1980 | Ryerson | |
| 4,267,653 | A | 5/1981 | Hahn et al. | |
| 4,317,300 | A | 3/1982 | Emrich et al. | |
| 4,329,798 | A | 5/1982 | Edwards | |
| 4,335,532 | A | 6/1982 | Hahn et al. | |
| 4,359,102 | A | 11/1982 | Gurries et al. | |
| 4,404,760 | A | 9/1983 | Hahn et al. | |
| 4,433,496 | A | 2/1984 | Jones et al. | |
| 4,449,309 | A | 5/1984 | Hemphill | |
| 4,457,380 | A | 7/1984 | Curry | |
| 4,479,734 | A | 10/1984 | Rother | |
| 4,501,079 | A | 2/1985 | Hahn et al. | |
| 4,577,423 | A | 3/1986 | Hahn | |
| 4,625,439 | A | 12/1986 | Johansson et al. | |
| 4,642,920 | A | 2/1987 | Lehnhoff | |
| 4,748,754 | A | 6/1988 | Schwappach | |
| 4,801,165 | A | 1/1989 | Pyle | |
| RE33,042 | E | 9/1989 | Emrich | |
| 4,899,830 | A | 2/1990 | Maguina-Larco | |
| 4,965,945 | A | 10/1990 | Emrich | |
| 4,966,240 | A | 10/1990 | Aikawa | |
| 4,980,980 | A | 1/1991 | Schadov et al. | |
| 5,005,304 | A | 4/1991 | Briscoe et al. | |
| 5,016,365 | A | 5/1991 | Robinson | |
| 5,052,134 | A | 10/1991 | Bierwith | |
| 5,056,243 | A | 10/1991 | Sprunger et al. | |
| 5,063,695 | A | 11/1991 | Briscoe et al. | |
| 5,063,696 | A | 11/1991 | Smith | |
| 5,074,063 | A | 12/1991 | Vannette | |
| 5,077,918 | A | 1/1992 | Garman | |
| 5,088,214 | A | 2/1992 | Jones | |
| 5,152,088 | A | 10/1992 | Hahn | |
| 5,177,886 | A | 1/1993 | Klett | |
| 5,197,587 | A | 3/1993 | Malmberg | |
| 5,241,765 | A | 9/1993 | Jones et al. | |
| 5,311,681 | A | 5/1994 | Ruvang et al. | |
| 5,325,615 | A | 7/1994 | Hutchins et al. | |
| 5,331,754 | A | 7/1994 | Ruvang | |
| 5,337,495 | A | 8/1994 | Pippins | |
| 5,410,826 | A | 5/1995 | Immel et al. | |
| 5,412,885 | A | 5/1995 | Cornelius | |
| 5,417,518 | A | 5/1995 | Bierwith | |
| 5,435,084 | A | 7/1995 | Immel | |
| 5,438,774 | A | 8/1995 | Fletcher et al. | |
| 5,452,529 | A | 9/1995 | Neuenfeldt et al. | |
| 5,465,512 | A | 11/1995 | Livesay et al. | |
| 5,526,592 | A * | 6/1996 | Bierwith | 37/451 |
| 5,553,409 | A | 9/1996 | Irving | |
| 5,564,508 | A | 10/1996 | Renski | |
| 5,607,195 | A | 3/1997 | Antonucci | |
| 5,634,285 | A | 6/1997 | Renski | |
| 5,638,621 | A | 6/1997 | Keech et al. | |
| 5,653,048 | A | 8/1997 | Jones et al. | |
| 5,784,813 | A | 7/1998 | Balassa et al. | |
| 5,806,215 | A | 9/1998 | Matthews | |
| 5,868,518 | A | 2/1999 | Chesterfield et al. | |
| 5,909,962 | A | 6/1999 | Livesay et al. | |
| 5,926,982 | A | 7/1999 | Keech et al. | |
| 5,937,550 | A | 8/1999 | Emrich | |
| 5,964,547 | A | 10/1999 | Brinkley | |
| 6,928,759 | B2 * | 8/2005 | Kasim | 37/452 |
| RE42,629 | E | 8/2011 | Jones et al. | |
| 8,074,383 | B2 * | 12/2011 | McClanahan | 37/455 |
| 2004/0098886 | A1 * | 5/2004 | Hohmann et al. | 37/451 |
| 2007/0044349 | A1 | 3/2007 | McClanahan et al. | |
| 2008/0092412 | A1 * | 4/2008 | McClanahan et al. | 37/451 |
| 2013/0145659 | A1 | 6/2013 | LaHood et al. | |
| 2015/0101218 | A1 * | 4/2015 | Serrurier et al. | 37/444 |

FOREIGN PATENT DOCUMENTS

| | | |
|---|---|---|
| GB | 2 111 558 A | 7/1983 |
| JP | 03-059229 | 3/1991 |

* cited by examiner

BUCKET LIP PROTECTION ASSEMBLIES AND LIP ADAPTERS FOR SAME

TECHNICAL FIELD

The present disclosure relates generally to protection assemblies and, more particularly, to protection assemblies for bucket lips.

BACKGROUND

Many earth-working machines, such as, for example, loaders, excavators, hydraulic mining shovels, cable shovels, bucket wheels, and draglines, include buckets for moving material (e.g., for digging material out of the earth). These buckets are often subjected to extreme wear from abrasion and impacts experienced while moving the material In order to mitigate the wear, replaceable lip protectors are fit to lips of the buckets, and engage the material being moved.

FIG. 1 provides an example of a prior art protector assembly 10, which is disclosed by U.S. Pat. No. 5,412,885 to Cornelius. As shown, protector assembly 10 includes a protector mounting lug 12 and a replaceable lip protector 14. Mounting lug 12 has a laterally disposed flange 16, and lip protector 14 has a cavity 18 with load transferring surfaces. When secured to mounting lug 12 by flex pins 20, the load transferring surfaces of lip protector 14 are in mating contact with flange 16. The load transferring surfaces are thus able to transfer load from lip protector 14 to mounting lug 12.

Protector assembly 10 may provide certain benefits in some applications. However, it may have certain drawbacks. For example, flex pins 20 may be difficult to remove and/or install when scaled for large buckets. As another example, mounting lug 12 may allow undesirable movement of lip protector 14 during some portion of assembly 10's operational life. The disclosed embodiments may help solve these problems.

SUMMARY

One disclosed embodiment relates to a lip adapter for stabilizing a lip protector relative to a bucket lip. The lip adapter may include a plurality of lip protector engagement surfaces defining at least two recessed portions and at least one non-recessed portion of the lip adapter. The lip adapter may also include a bucket lip attachment portion.

Another disclosed embodiment relates to a bucket lip protection assembly. The bucket lip protection assembly may include a bucket lip protector. The lip protector may include a front portion for engaging material being moved. The lip protector may also include a rear portion opposite the front portion. In addition, the bucket lip protection assembly may include a lip adapter for stabilizing the lip protector relative to a bucket lip. The lip adapter may include a plurality of lip protector engagement surfaces, which may define at least two recessed portions and at least one non-recessed portion of the lip adapter. The lip adapter may also include a bucket lip attachment portion.

A further disclosed embodiment relates to a bucket lip protection assembly attached to a bucket. The bucket lip protection assembly may include a bucket lip protector, a retention system for retaining the lip protector on the bucket, and a lip adapter for stabilizing the lip protector relative to a lip of the bucket. The lip protector may include a front portion for engaging material being moved, and a rear portion opposite the front portion. The retention system may include a boss, which may be welded to the bucket. The boss may include a protrusion extending away from the bucket. The boss may also include a generally T-shaped portion extending longitudinally along the bucket, which may engage surfaces of the rear portion of the lip protector to prevent the lip protector from moving toward or away from the bucket along the direction in which the protrusion extends. In addition, the retention system may include a lock situated in a bore of the lip protector. The lock may at least partially surround the protrusion to prevent the lip protector from moving longitudinally relative to the bucket. The lip adapter may include a plurality of lip protector engagement surfaces, which may define at least one recessed portion and at least one non-recessed portion of the lip adapter. The lip adapter may also include a bucket lip attachment portion, which may be welded to the lip of the bucket. The rear portion of the lip protector may include at least one protrusion. The at least one protrusion may be configured to mate with the at least one recessed portion of the lip adapter to prevent the lip protector from moving laterally relative to the bucket.

DETAILED DESCRIPTION

Figure 2:
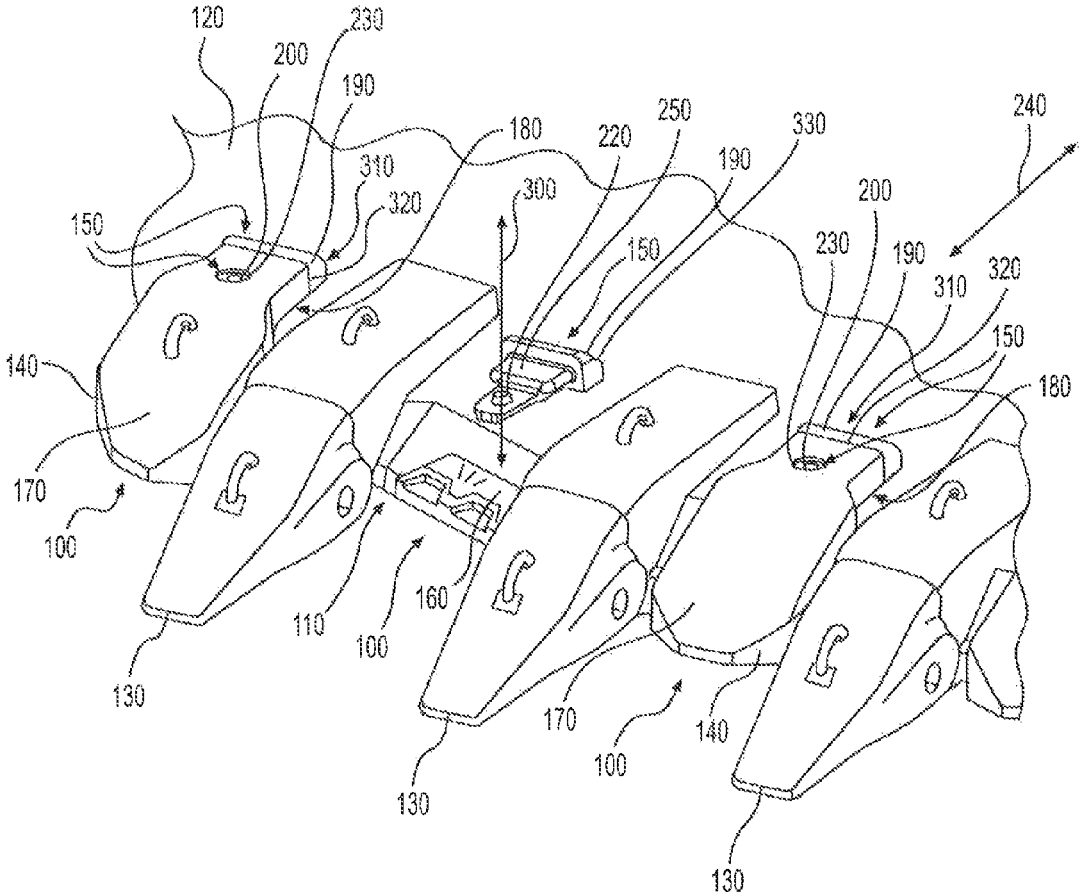
FIG. 2 is a perspective view of bucket lip protection assemblies according to the present disclosure.

FIG. 2 illustrates components of exemplary bucket lip protection assemblies 100, which may be attached to a bucket lip 110 of a bucket 120. For example, bucket 120 may be associated with an earth-working machine (e.g., a loader, an excavator, a hydraulic, mining shovel, a cable shovel, a bucket wheel, a dragline, or another type of earth-working machine), and may be used for moving material (e.g., for digging material out of the earth). Lip protection assemblies 100 may be attached to lip 110 between teeth 130, and may mitigate wear from abrasion and impacts experienced by lip 110 while moving the material.

Each lip protection assembly 100 may include a bucket lip protector 140, a retention system 150 for retaining lip protector 140 on bucket 120, and a lip adapter 160 for stabilizing lip protector 140 relative to lip 110. Lip protector 140 may include a front portion 170 for engaging material being moved. In addition, lip protector 140 may include a rear portion 180 opposite front portion 170 for engaging retention system 150 and lip adapter 160.

As shown, retention system 150 may include a boss 190, which may be attached to bucket 120. For example, boss 190 may be attached to bucket 120 using one or more welds, mechanical fasteners, and/or adhesives. Retention system 150 may also include a lock 200.

Boss 190 may include a protrusion 220, which may extend away from bucket 120. As shown, protrusion 220 may be frustum-shaped. In some embodiments, however, protrusion 220 may be cylinder-shaped. When lip protector 140 is attached to bucket 120, lock 200 may be situated in a bore 230 of lip protector 140 and at least partially surround protrusion 220. Lock 200 may thus prevent lip protector 140 from moving relative to bucket 120 in a longitudinal direction 240 of bucket 120.

Figure 3:
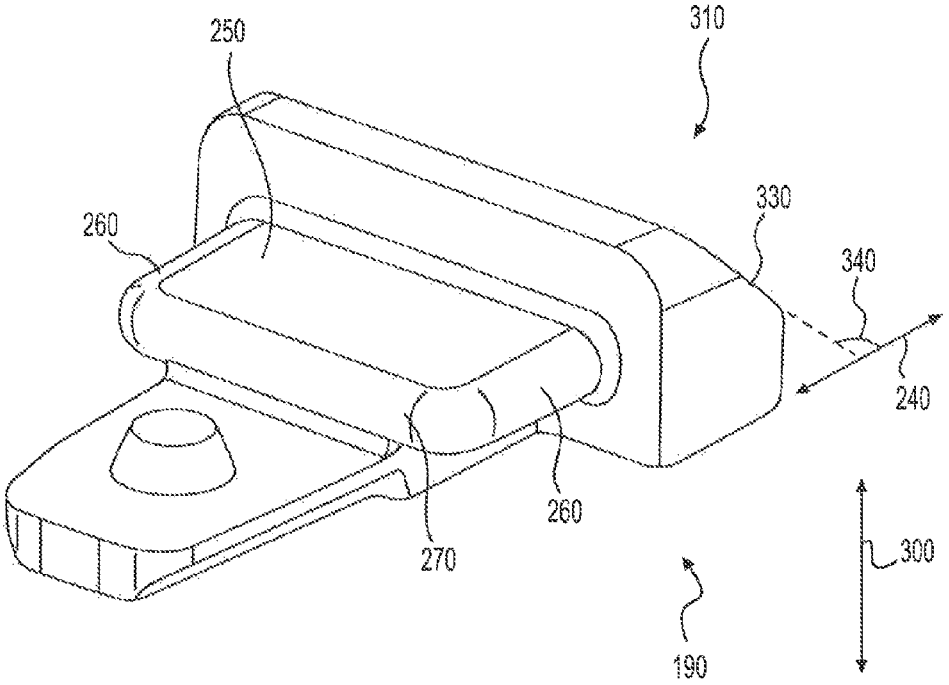
FIG. 3 is a perspective view of a boss of one of the bucket lip protection assemblies of FIG. 2.
Figure 6:
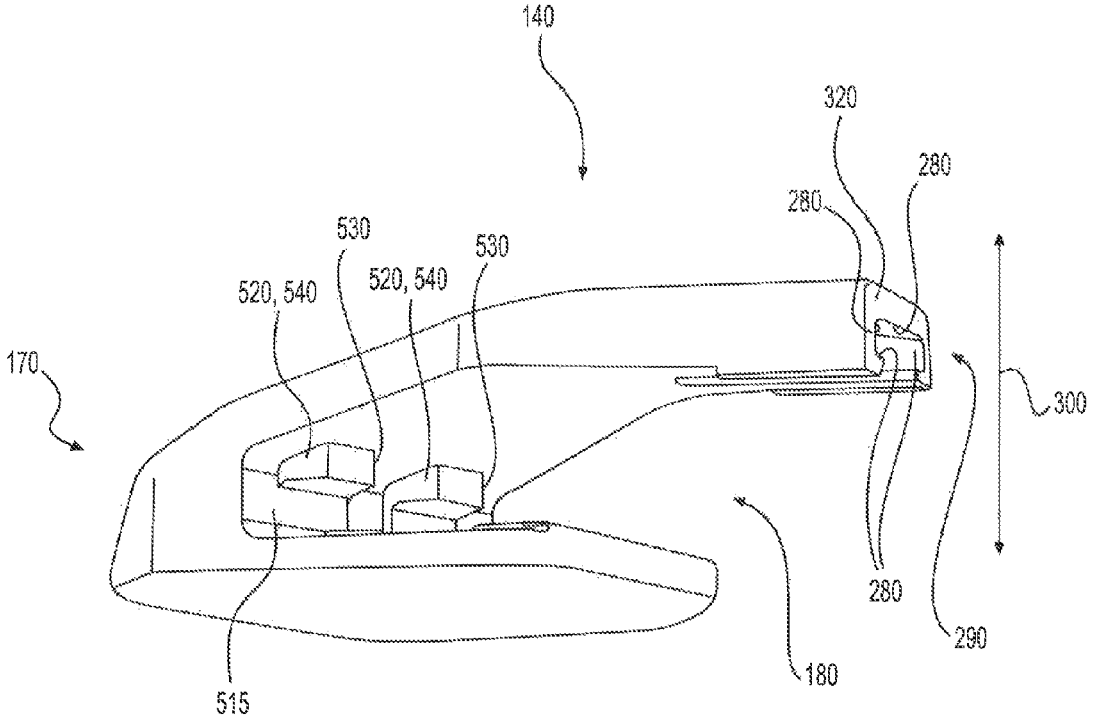
FIG. 6 is a perspective view of a bucket lip protector of one of the bucket lip protection assemblies of FIG. 2.

Boss 190 may also include a generally T-shaped portion 250, which may extend along bucket 120 in longitudinal direction 240. Referring to FIG. 3, T-shaped portion 250 may have laterally outer edges 260 that are radiused to reduce stress within T-shaped portion 250. For example, edges 260 may be continuous rounds. In addition, T-shaped portion 250 may also have a front edge 270 that is radiused to reduce stress within T-shaped portion 250. Like edges 260, edge 270 may also be a continuous round. Referring to FIG. 6, when lip protector 140 is attached to bucket 120, T-shaped portion 250 may engage surfaces 280 of rear portion 180, which may define a corresponding generally T-shaped cavity 290 of lip protector 140. By doing so, T-shaped portion 250 may prevent lip protector 140 from moving toward or away from bucket 120 along a direction 300 in which protrusion 220 extends. It is contemplated that the continuous rounds of edges 260, 270 may reduce stresses on lip protector 140.

Figure 1:
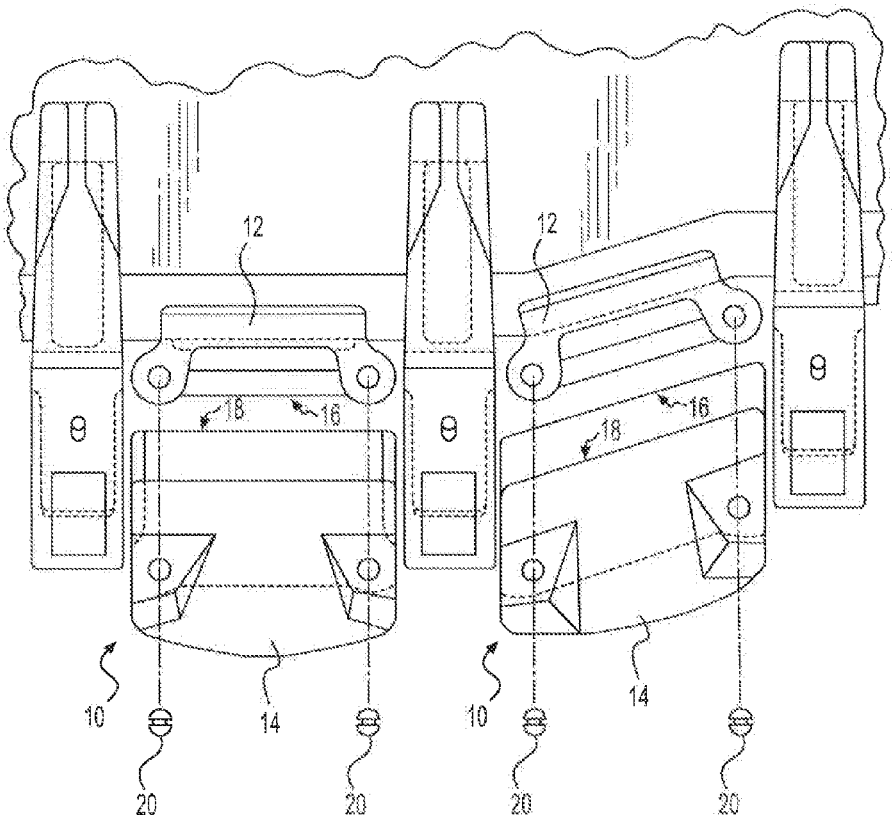
FIG. 1 Prior Art
FIG. 1 is a view of a prior art protector assembly.

Additionally, boss 190 may include a rear portion 310, which may be configured to deflect material over lip protector 140 as material flows out of bucket 120. In particular, rear portion 310 may be formed from steel, and, as shown in FIG. 1, rear portion 310 may extend at least as far away from bucket 120 as a rear-most surface 320 of lip protector 140 that faces rear portion 310. In addition, rear portion 310 may include a deflection surface 330 that is angled with respect to longitudinal direction 240 of bucket 120. For example, an angle 340 between deflection surface 330 and longitudinal direction 240 may be between approximately 90 degrees and approximately 180 degrees. In one embodiment of boss 190, angle 340 may be approximately 135 degrees. In other embodiments, rear portion 310 may be round or may be rectangular- or square-shaped.

Figure 4:
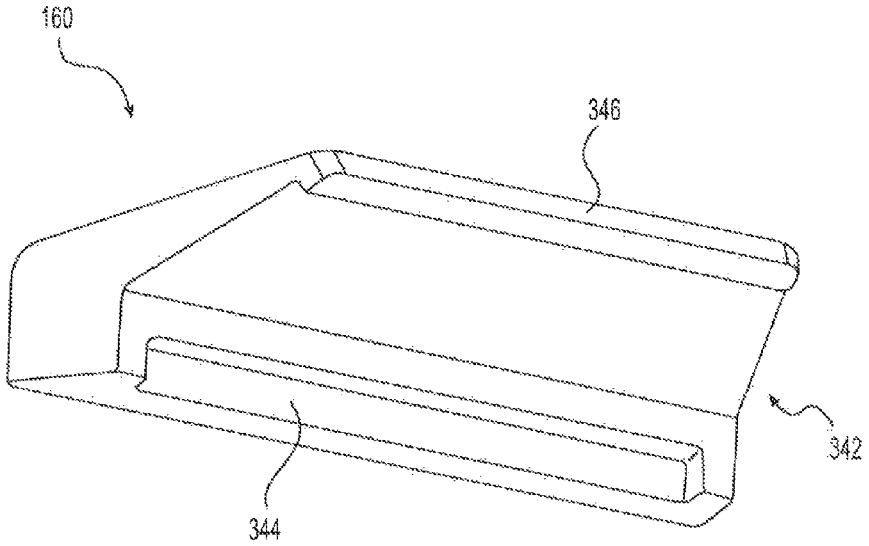
FIG. 4 is a perspective view of a lip adapter of one of the bucket lip protection assemblies of FIG. 2.

As shown in FIG. 4, lip adapter 160 may include a bucket lip attachment portion 342, which may be attached to lip 110 of bucket 120. For example, lip attachment portion 342 may be attached to lip 110 using one or more welds. In such embodiments, weld material may be situated in a recess 344 formed in lip adapter 160 and/or along a rear edge 346 of lip adapter 160. Alternatively, lip attachment portion 342 may be attached to lip 110 using mechanical fasteners and/or adhesives.

Figure 5:
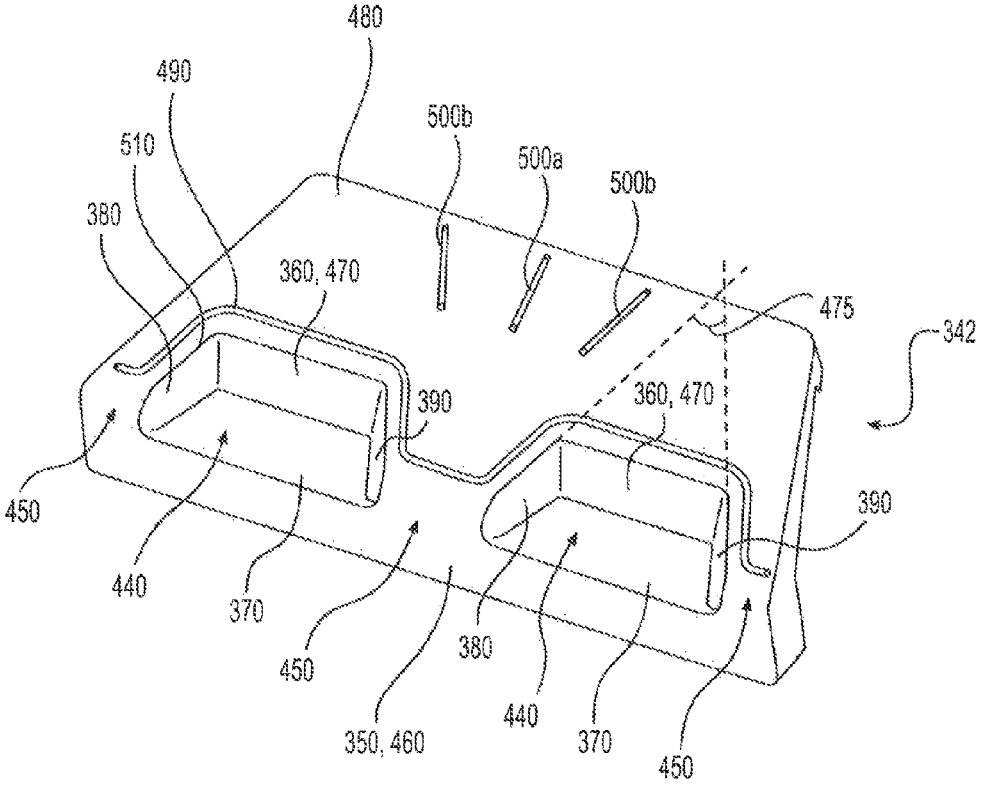
FIG. 5 is another perspective view of the lip adapter of FIG. 4.

Referring to FIG. 5, lip adapter 160 may also include a plurality of lip protector engagement surfaces 350, 360, 370, 380, 390, which may define one or more recessed portions 440 and one or more non-recessed portions 450 of lip adapter 160. Although FIG. 5 illustrates engagement surfaces 350, 360, 370, 380, 390 as defining two recessed portions 440 and three non-recessed portions 450, it should be understood that lip protector engagement surfaces 350, 360, 370, 380, 390 could define another number of recessed portions 440 and/or non-recessed portions 450. For example, in some embodiments, lip protector engagement surfaces 350, 360, 370, 380, 390 may define three recessed portions 440 and four non-recessed portions 450. In other embodiments, lip protector engagement surfaces 350, 360, 370, 380, 390 may define four recessed portions 440 and five non-recessed portions 450. And in yet other embodiments, lip protector engagement surfaces 350, 360, 370, 380, 390 may define more than four recessed portions 440 and/or more than five non-recessed portions 450.

Non-recessed lip protector engagement surface 350 may define a front end 460 of each of non-recessed portions 450, while recessed lip protector engagement surfaces 360 may define a rear end 470 of each recessed portion 440. As shown, lip protector engagement surfaces 350, 360 may be generally planar, and may be approximately parallel to each other. However, it should be understood that one or more of engagement surfaces 350, 360 could be otherwise shaped or angled in some embodiments. For example, engagement surfaces 350, 360 could be curved. As another example, engagement surface 350 could be angled relative to engagement surfaces 360, or one engagement surface 360 could be angled relative to another engagement surface 360.

Recessed lip protector engagement surface 370 may define a floor of each recessed portion 440. As shown, lip protector engagement surface 370 may be generally planar, and may be approximately perpendicular to engagement surfaces 350, 360. However, it should be understood that engagement surface 370 could be otherwise shaped or angled in some embodiments. For example, like engagement surfaces 350, 360, engagement surface 370 could be curved. As another example, engagement surface 370 could be angled relative to one or more of engagement surfaces 350, 360.

A pair of lip protector lateral engagement surfaces 380, 390 may connect each recessed lip protector engagement surface 360 to non-recessed lip protector engagement surface 350. As shown, lip protector lateral engagement surfaces 380, 390 may be generally planar, angled with respect to each other and with respect to engagement surfaces 350, 360, and approximately perpendicular to recessed lip protector engagement surface 370. For example, an angle 475 between surfaces 380, 390 may be between approximately 0 degrees and approximately 120 degrees. More specifically, angle 475 may be between approximately 30 degrees and approximately 90 degrees. For example, angle 475 may be related to a spade angle of bucket 120 (i.e., the supplement of an angle between a portion of lip 110 that is perpendicular to longitudinal direction 240 of bucket 120, and a portion of lip 110 that is not perpendicular to longitudinal direction 240). In particular, angle 475 may be two degrees plus twice the spade angle. However, it should be understood that lateral engagement surfaces 380, 390 may be otherwise angled or shaped in some embodiments. For example, engagement surfaces 380, 390 could be approximately parallel to each other, or one or both of engagement surfaces 380, 390 could be angled with respect to engagement surface 370. As another example, engagement surfaces 380, 390 could be approximately perpendicular to one or more of engagement surfaces 350, 360. As yet another example, like engagement surfaces 350, 360, and 370, engagement surfaces 380, 390 could be curved.

Sill referring to FIG. 5, lip adapter 160 may also include a top surface 480, which may be opposite bucket lip attachment portion 342. In addition, lip adapter 160 may include at least one protrusion, which may extend outward from top surface 480. For example, lip adapter 160 may include a wear indicator protrusion 490, which may indicate the remaining operational life of lip adapter 160 (when protrusion 490 wears off, lip adapter 160 should be replaced). As another example, lip adapter 160 may include one or more alignment protrusions 500, which may facilitate proper alignment of adapter 160 relative to lip 110 during installation of lip adapter 160.

As shown in FIG. 5, protrusion 490 may generally trace a front edge 510 of top surface 480. In particular, protrusion 490 may extend along top surface 480 in a direction approximately parallel to non-recessed lip protector engagement surface 350, bend, and extend along top surface 480 in a direction approximately parallel to lip protector lateral engagement surface 380. Protrusion 490 may then bend again and extend along top surface 480 in a direction approximately parallel to recessed lip protector engagement surface 360. After bending yet again, protrusion 490 may then extend along top surface 480 in a direction approximately parallel to lip protector lateral engagement surface 390. Protrusion 490 may then bend again and extend along top surface 480 in the direction approximately parallel to non-recessed lip protector engagement surface 350. Such bends and extensions may be repeated until protrusion 490 traverses the entire length of top surface 480. Alternatively, they may only be repeated a limited number of times. In yet another alternative, they may not be repeated. Alternatively, sonic of the bends and/or extensions may be repeated, while others are not repeated. In yet another alternative, some of the bends and/or extensions may not be included at all, or may be otherwise shaped. For example, the extensions may be non-linear, or may extend at angles relative to engagement surfaces 350, 360, 380, 390 instead of being approximately parallel to engagement surfaces 350, 360, 380, 390.

Again referring to FIG. 5, lip adapter 160 may include three alignment protrusions 500. For example, lip adapter 160 may include a central alignment protrusion 500*a*, which may extend in a direction approximately perpendicular to non-recessed lip protector engagement surface 350. In addition, lip adapter 160 may include two offset alignment protrusions 500*b*,which may extend in directions that are angled with respect to non-recessed lip protector engagement surface 350. Protrusion 500*a* may be used to align lip adapter 160 when attaching adapter 160 to a portion of lip 110 that is perpendicular to longitudinal direction 240 of bucket 120, while one of protrusions 500*b* may be used to align lip adapter 160 when attaching adapter 160 to a portion of lip 110 that is not perpendicular to longitudinal direction 240. Although protrusions 500*a* and 500*b* may be desirable for many installations, it is contemplated that certain embodiments may not include both protrusions 500*a* and 500*b*, or may include additional protrusions 500. For example, lip adapters 160 for use with buckets 120 having no lip portions perpendicular to longitudinal direction 240 may not include central alignment protrusion 500*a*.

Referring to FIG. 6, as previously discussed, lip protector 140 may include rear portion 180 for engaging retention system 150 and lip adapter 160. Rear portion 180 may include engagement surfaces 280, which may define a generally T-shaped cavity 290 corresponding to generally T-shaped portion 250 of boss 190 of retention system 150. When lip protector 140 is attached to bucket 120, surfaces 280 may engage T-shaped portion 250 to prevent lip protector 140 from moving toward or away from bucket 120 along direction 300 (referring to FIG. 2).

Rear portion 180 may also include a primary engagement surface 515, which may be configured to engage non-recessed lip protector engagement surface 350 of lip adapter 160. When lip protector 140 is attached to bucket 120, surface 515 may oppose surface 350 to prevent lip protector 140 from moving longitudinally relative to bucket 120.

In addition, rear portion 180 may include one or more protrusions 520, which may be configured to mate with recessed portions 440. For example, rear portion 180 may include a protrusion 520 corresponding to each recessed portion 440, and each protrusion 520 may include a pair of lateral engagement surfaces 530, 540 configured to engage lateral engagement surfaces 380, 390 of recessed portion 440. When lip protector 140 is attached to bucket 120, surfaces 530, 540 may oppose surfaces 380, 390 to prevent lip protector 140 from moving laterally relative to bucket 120.

Protrusions 520 may also be configured to engage recessed lip protection engagement surfaces 360 only after at least one of lip protector 140 or lip adapter 160 has experienced wear. That is, given the opposing contact between surface 515 and surface 350, protrusions 520 may not be long enough to contact surfaces 360 until after surfaces 515 and/or 350 have worn down. It should be understood, however, that some embodiments may include protrusions 520 that are long enough to contact surfaces 360 before surfaces 515 and/or 350 have worn down.

INDUSTRIAL APPLICABILITY

The disclosed bucket lip protection assemblies may be applicable to buckets of earth-working machines, such as, for example loaders, excavators, hydraulic mining shovels, cable shovels, bucket wheels, and draglines, and may mitigate wear from abrasion and impacts experienced by lips of the buckets while moving material. The disclosed bucket lip protection assemblies may have various advantages over prior art bucket lip protection assemblies. For example, they may be relatively easy to remove and/or install regardless of bucket size. In addition, they may prevent undesirable movement of lip protectors over extended time periods. Specific advantages of the disclosed bucket lip protection assemblies will now be described.

Bucket lip protection assembly 100's retention system 150 may retain lip protector 140 on bucket 120 without using pins that may be difficult to remove and/or install when scaled for large buckets. Instead, retention system 150 may retain lip protector 140 on bucket 120 using lock 200 and boss 190. As discussed above, when lip protector 140 is attached to bucket 120, lock 200 may be situated in bore 230 of lip protector 140 and at least partially surround protrusion 220 of boss 190. Lock 200 may thus prevent lip protector 140 from moving relative to bucket 120 in longitudinal direction 240 of bucket 120. Also, when lip protector 140 is attached to bucket 120, T-shaped portion 250 may engage surfaces 280 of rear portion 180, which may define a corresponding T-shaped cavity 290 of lip protector 140. By doing so, T-shaped portion 250 may prevent lip protector 140 from moving toward or away from bucket 120 along direction 300.

Bucket lip protection assembly 100's lip adapter 160 may stabilize lip protector 140 relative to lip 110 of bucket 120. As discussed above, when lip protector 140 is attached to bucket 120, surface 515 of lip protector 140 may oppose surface 350 of lip adapter 160 to prevent lip protector 140 from moving longitudinally relative to bucket 120. In addition, When surfaces 515, 350 wear down, protrusions 520 of lip protector 140 may engage surfaces 360 of lip adapter 160 to prevent lip protector from moving longitudinally relative to bucket 120. Also, throughout the operational life of bucket lip protection assembly 100, surfaces 530, 540 of lip protector 140 may oppose surfaces 380, 390 of lip adapter 160 to prevent lip protector 140 from moving laterally relative to bucket 120.

It will be apparent to those skilled in the art that various modifications and variations can be made to the disclosed bucket lip protection assemblies. Other embodiments will be apparent to those skilled in the art from consideration of the specification and practice of the disclosed bucket lip protection assemblies. It is intended that the specification and examples be considered as exemplary only, with a true scope being indicated by the following claims and their equivalents.

What is claimed is:

1. A lip adapter for stabilizing a lip protector relative to a bucket lip, the lip adapter comprising:

a plurality of lip protector engagement surfaces defining at least two recessed portions and at least one non-recessed portion of the lip adapter;

a bucket lip attachment portion;

a first alignment protrusion formed on an upper surface of the lip adapter; and a second alignment protrusion formed on the upper surface of the lip adapter, wherein the first and second alignment protrusions are formed at different angles with respect to the non-recessed portion of the lip adapter.

2. The lip adapter of claim 1, wherein the plurality of lip protector engagement surfaces include:

a generally planar, non-recessed lip protector engagement surface defining a front end of the at least one non-recessed portion of the lip adapter; and a generally planar, first recessed lip protector engagement surface defining a rear end of each of the at least two recessed portions.

3. The lip adapter of claim 2, wherein the non-recessed lip protector engagement surface is approximately parallel to the first recessed lip protector engagement surface.

4. The lip adapter of claim 2, wherein the plurality of lip protector engagement surfaces include a generally planar, second recessed lip protector engagement surface defining a floor of each of the at least two recessed portions.

5. The lip adapter of claim 4, wherein the second recessed lip protector engagement surface is approximately perpendicular to the first recessed lip protector engagement surface.

6. The lip adapter of claim 4, wherein the plurality of lip protector engagement surfaces include a pair of lip protector lateral engagement surfaces connecting the first recessed lip protector engagement surface to the non-recessed lip protector engagement surface.

7. The lip adapter of claim 6, wherein one of the pair of lip protector lateral engagement surfaces is angled with respect to the other of the pair of lip protector lateral engagement surface.

8. The lip adapter of claim 6, wherein the pair of lip protector lateral engagement surfaces are approximately perpendicular to the second recessed lip protector engagement surface.

9. The lip adapter of claim 6, comprising:

a top surface opposite the bucket lip attachment portion; and at least one protrusion extending outward from the top surface.

10. The lip adapter of claim 9, wherein the at least one protrusion extends along the top surface in a direction approximately parallel to the first recessed lip protector engagement surface.

11. The lip adapter of claim 10, wherein the at least one protrusion extends along the top surface in a direction approximately parallel to at least one of the pair of lip protector lateral engagement surfaces.

12. The lip adapter of claim 1, wherein the plurality of lip protector engagement surfaces define two recessed portions of the lip adapter.

13. A bucket lip protection assembly, comprising:

a bucket lip protector including a front portion for engaging material being moved, and a rear portion opposite the front portion; and a lip adapter for stabilizing the lip protector relative to a bucket lip, the lip adapter including:

a plurality of lip protector engagement surfaces defining at least two recessed portions and at least one non-recessed portion of the lip adapter;

a bucket lip attachment portion;

a first alignment protrusion formed on an upper surface of the lip adapter; and a second alignment protrusion formed on the upper surface of the lip adapter, wherein the first and second alignment protrusions are formed at different angles with respect to the non-recessed portion of the lip adapter.

14. The bucket lip protection assembly of claim 13, wherein the rear portion of the lip protector includes at least two protrusions, each configured to mate with one of the at least two recessed portions of the lip adapter.

15. The bucket lip protection assembly of claim 14, wherein:

the plurality of lip protector engagement surfaces include:

a generally planar, non-recessed lip protector engagement surface defining a front end of the at least one non-recessed portion of the lip adapter; and a generally planar, recessed lip protector engagement surface defining a rear end of each of the at least two recessed portions;

the rear portion includes a primary engagement surface configured to engage the non-recessed lip protector engagement surface; and each of the at least two protrusions is configured to engage the recessed lip protector engagement surface only after at least one of the lip protector or the lip adapter has experienced wear.

16. The bucket lip protection assembly of claim 15, wherein the non-recessed lip protector engagement surface is approximately parallel to the recessed lip protector engagement surface.

17. The bucket lip protection assembly of claim 15, wherein:

the plurality of lip protector engagement surfaces include a pair of lip protector lateral engagement surfaces connecting the recessed lip protector engagement surface of each of the at least two recessed portions to the non-recessed lip protector engagement surface; and each of the at least two protrusions includes a pair of lateral engagement surfaces configured to engage the pair of lip protector lateral engagement surfaces.

18. The bucket lip protection assembly of claim 17, wherein one of the pair of lip protector lateral engagement surfaces is angled with respect to the other of the pair of lip protector lateral engagement surfaces.

* * * * *